US005144892A

United States Patent [19]

Tupek et al.

[11] Patent Number: 5,144,892

[45] Date of Patent: Sep. 8, 1992

[54] PRINTING FLUID CIRCULATOR FOR USE IN A PRINTING PRESS

[75] Inventors: Garry F. Tupek, Naperville; John W. Manser, Elgin; James M. Komaniecki, Minooka, all of Ill.

[73] Assignee: Rockwell International Corporation, El Segundo, Calif.

[21] Appl. No.: 701,269

[22] Filed: May 16, 1991

[51] Int. Cl.[5] ..... B41F 31/06

[52] U.S. Cl. ..... 101/363; 101/DIG. 34; 366/320

[58] Field of Search ..... 101/210, 340, 344, 347, 101/350, 355, 356, 360, 363, 364, DIG. 34; 366/320; 118/612

[56] References Cited

U.S. PATENT DOCUMENTS

| | | | |
|---|---|---|---|
| 782,277 | 2/1905 | Ruder | 101/375 |
| 1,001,508 | 8/1911 | Graig | 366/320 |
| 1,077,882 | 11/1913 | Holz | 101/DIG. 34 |
| 2,366,375 | 1/1945 | Worthington | 101/364 |
| 3,138,167 | 6/1964 | Fisher | 366/320 |

FOREIGN PATENT DOCUMENTS

| | | | |
|---|---|---|---|
| 2520909 | 12/1975 | Fed. Rep. of Germany | 366/320 |

*Primary Examiner*—Edgar S. Burr
*Assistant Examiner*—Stephen R. Funk
*Attorney, Agent, or Firm*—C. B. Patti; V. L. Sewell; H. F. Hamann

[57] ABSTRACT

A printing fluid circulating device for use in a printing press having a printing fluid container (32) for containing printing fluid and having a rotatable pickup roller (34) partially submerged in the printing fluid in the container (32). The pickup roller (34) has a surface for picking up printing fluid. The printing fluid circulating device has at least one outer ribbon (10, 12) having a predetermined diameter and a predetermined surface area and at least one inner ribbon (14, 16) also having a predetermined diameter and a predetermined surface area. The diameter of the inner ribbon (14, 16) is less than the diameter of the outer ribbon (10, 12) and the surface area of the outer ribbon (10, 12) is less than the surface area of the inner ribbon (14, 16). Each of the outer and inner ribbons (10, 12, 14, 16) has a substantially helix configuration, the helix configuration of the inner ribbon (14, 16) being opposite the helix configuration of the outer ribbon (10, 12). A rotatable shaft (18) for supporting the outer ribbon (10, 12) and the inner ribbon (14, 16) about a common axis is provided.

18 Claims, 7 Drawing Sheets

PRINTING FLUID CIRCULATOR FOR USE IN A PRINTING PRESS

BACKGROUND OF THE INVENTION

The present invention relates to a printing process, such as a keyless lithographic printing process and, in particular, to a device for circulating ink in a printing fluid pan in a printing press.

In the art and practice of high-speed lithographic offset printing, for example, ink is more-or-less continuously conveyed from a suitable reservoir by means of a series of coextensive rollers to a planographic printing plate where the image portions of the printing plate accept ink from the last of the series of inking rollers. A portion of that ink is then transferred to a printing blanket as a reverse image from which a portion of the ink is transferred in the form of a right-reading image to paper or another suitable substrate. It is essential in conventional lithographic printing processes that dampening water containing proprietary additives also be conveyed more-or-less continuously to the printing plate where, by transferring in part to the non-image areas of the printing plate, the water operates to keep those non-image areas free of ink.

In some prior art printing press systems, both the ink and the dampening water are continuously and separately made available to all parts of the printing plate, image and non-image areas alike; and in the absence of dampening water, the printing plate will accept ink in both the image and non-image areas of its surface.

Lithographic printing plate surfaces in the absence of imaging materials have minute interstices and an overall hydrophilic or water-loving character that enhance retention of water rather than ink in the non-imaged areas. Imaging this hydrophilic plate surface creates oleophilic areas according to the desired image format. Subsequently, when water is presented to the inked, imaged plate in appropriate amounts only that ink residing in non-image areas becomes debonded. In its simplest view, this action accounts for the continuous image and non-image differentiation at the printing plate surface which differentiation is essential and integral to the lithographic printing process.

Newspaper printing configurations are known which rely on the inking train of rollers to carry dampening water to the printing plate. Configurations such as those noted above will, together with appropriate ink and dampening concentrate selections, function such that the ink, referred to as a printing fluid, itself carries all of the required dampening water to the printing plate, yet the press functions and is controlled more-or-less conventionally from the viewpoint of lithographic printing.

Planographic printing systems and elements thereof which do not require dampening water, and may therefore be termed single-fluid systems, are known in the prior art. Such systems rely in one way or another on low-surface-energy silicone non-image portions of the printing plate disallowing ink adhesion, thereby forming the basis for differentiation between ink-receptive nonsilicone image areas and of non-ink-receptive non-image silicone areas of the printing plate. Only ink needs to be available to the plate, dampening solutions being unnecessary.

In the printing press systems described above it is typical to provide a first roller, referred to as a pickup roller in the train of inking rollers which is partially submerged in a pan containing the ink or printing fluid.

As the pickup roller rotates, its surface picks up the printing fluid from the pan which in turn is transferred along the train of inking rollers. It is well known in the prior art that it is necessary to circulate the ink within the pan past the surface of the pickup roller in order for an even film of ink to be picked up by the surface of the pickup roller. Prior art devices, generally referred to as mixers or agitators, have been used to circulate the ink within the pan. However, such prior art mixers or agitators have met with limited success in circulating the ink without uneven flow past the surface of the pickup roller. In order to overcome this problem prior art circulating pump systems were utilized in which a pump and possibly a reservoir are connected to the pan, and printing fluid is pumped through the pan in order to circulate it. Such ink pans are typically very tall having sloping sides that enabled gravity to gradually cause the viscous inks to flow toward the sump and maintain positive supply of ink to the circulating pump inlet. The pump then, in addition to draining the pan, homogenizes the reservoir ink and returns it as a fresh supply to the pan. Such constructions however, significantly increased the size of printing presses wherein multiple printing couples are combined in one press structure.

The present invention overcomes these drawbacks of the prior art and provides a novel circulating device which produces an even and constant flow of ink past the surface of the pickup roller and which is compact in size, thereby reducing the overall size configuration of the printing press in which it is used. The present invention also eliminates external recirculating pumps and associated piping in prior art keyless printing presses.

SUMMARY OF THE INVENTION

It is an object of the present invention to provide an improved circulating device for circulating printing fluid in a pan of a printing press.

It is another object of the present invention to provide an improved circulating device which circulates printing fluid past the surface of a pickup roller substantially evenly and substantially constantly.

It is yet another object of the present invention to provide an improved circulating device which rotates in only one direction.

In general terms the present invention is a printing fluid circulating means for use in a printing press having a container means for containing printing fluid and having a rotatable pickup roller partially submerged in the printing fluid in the container means. The pickup roller has a surface for picking u printing fluid. The printing fluid circulating means has at least one outer ribbon having a predetermined diameter and a predetermined surface area and at least one inner ribbon also having a predetermined diameter and a predetermined surface area. The diameter of the inner ribbon is less than the diameter of the outer ribbon and the surface area of the outer ribbon is a function of the surface area of the inner ribbon. Each of the outer and inner ribbons has a substantially helix configuration, the helix configuration of the inner ribbon being opposite the helix configuration of the outer ribbon. A rotatable means for supporting the outer ribbon and the inner ribbon about a common axis is provided. The circulating means is submerged in the printing fluid in the container means in spaced relation to the pickup roller such that rotation of the circulating means causes printing fluid to flow substantially evenly and substantially constantly past the surface of the pickup roller. The speed of rotation of the rotatable means and therefore of the inner and outer ribbons is a function of the type of printing fluid used. The circulating means also has a means for rotating in only one direction the rotatable means for supporting the inner and outer ribbons. This means for rotating rotates the rotatable means at a rotational speed which is a function of the viscosity of the printing fluid. It is to be understood that the term "printing fluid" can refer to either ink alone or a combination of ink and dampening fluid depending upon the application.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

DESCRIPTION OF THE PREFERRED EMBODIMENT

The present invention has general applicability but is most advantageously utilized in a keyless lithographic printing press.

Figure 1:
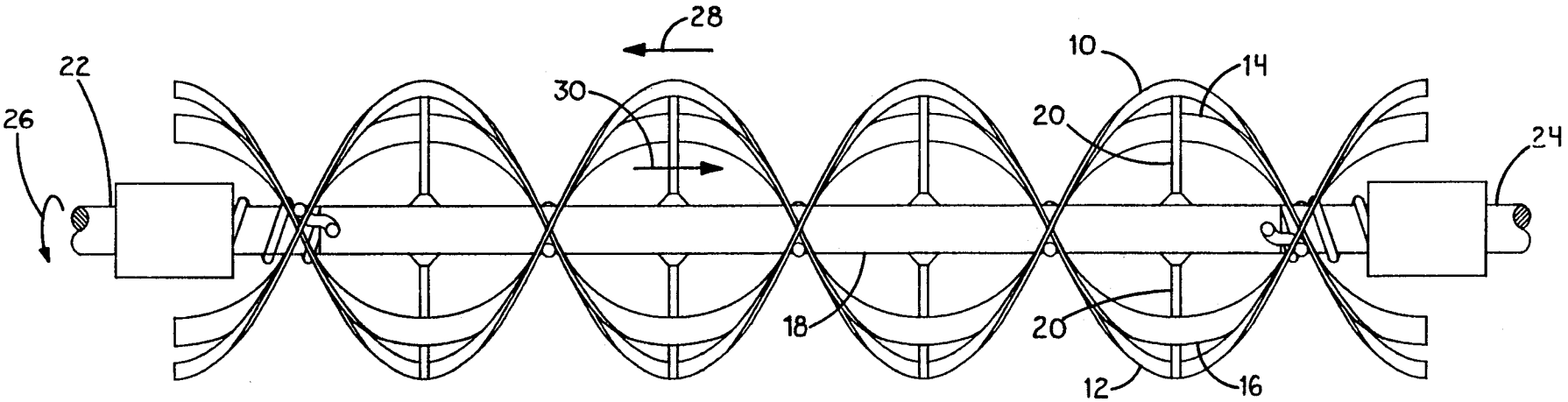
FIG. 1 is a side view of the printing fluid circulating means of the present invention.
Figure 2:
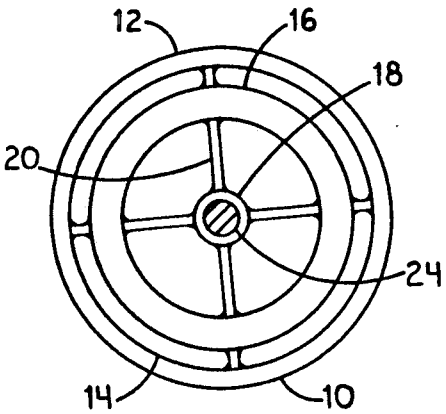
FIG. 2 is an end view of the FIG. printing fluid circulating means.
Figure 3:
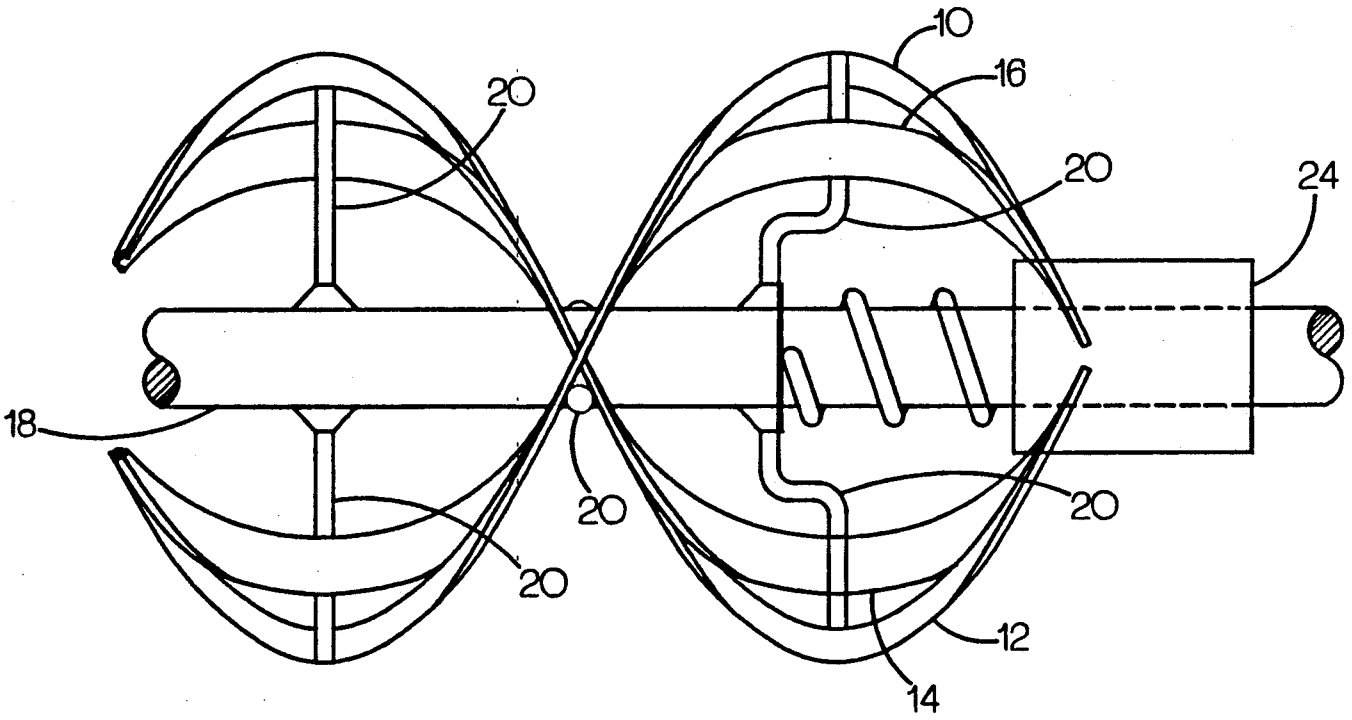
FIG. 3 is a partial top view of the FIG. 1 printing fluid circulating means.

The printing fluid circulating means of the present invention is depicted in a preferred embodiment in FIGS. 1-3. The printing fluid circulating means has a first outer ribbon 10 and a second outer ribbon 12, and also has a first inner ribbon 14 and a second inner ribbon 16. The inner and outer ribbons, 10, 12, 14 and 16 are attached to a shaft 18 by supports 20. The first and second ends 22, 24 of the shaft 18 are mounted in a printing fluid pan and one of the ends 22, 24, is connected to a motor or other means for rotating the shaft 18, thereby rotating the outer and inner ribbons 10, 12, 14 and 16.

Each of the first and second outer ribbons 10, 12, has a predetermined outside diameter D1 and each of the first and second inner ribbons 14, 16 has a predetermined outside diameter D2. Each of the outer and inner ribbons 10, 12, 14 and 16 is essentially a metal strip which has a defined surface area. Therefore, each of the first and second outer ribbons 10, 12 has a surface area A1 and each of the first and second inner ribbons 14, 16 has a surface area A2. As the shaft 18 is rotated in the direction indicated by arrow 26, the first and second outer ribbons 10, 12 cause the printing fluid to circulate in the direction indicated by arrow 28 and the first and second inner ribbons 14, 16 cause the printing fluid to circulate in the direction indicated by arrow 30. It is to be understood that the shaft 18 can be rotated in either direction. The present invention, however, allows the shaft 18 to be rotated in one direction continuously, and eliminate periodic stopping or reversing of rotation direction of the shaft 18. It is a novel aspect of the present invention that the printing fluid is circulated substantially evenly and substantially constantly when the surface area of the first and second outer ribbons 10, 12 is less than the surface area of the first and second inner ribbons 14, 16. It is a further novel aspect of the present invention that the speed of rotation of the shaft 18 is a function of the viscosity of the printing fluid. That is, depending upon the type of printing fluid utilized (for example, inks of different colors have different viscosities) the rotational speed of the shaft 18 will be changed in order to establish the even and continuous flow of printing fluid past the surface of the pickup roller.

In order to establish the flow of printing fluid as depicted, the outer ribbons 10, 12 and the inner ribbons 14, 16 have a helix configuration, the helix configuration of the inner ribbons 14, 16 being opposite relative to the helix configuration of the outer ribbons 10, 12. Each of the outer ribbons 10, 12 has a predetermined pitch P1 and each of the inner ribbons 14, 16 has a predetermined pitch P2. Furthermore, in the preferred embodiment, the pitch P1 is equal to the pitch P2. The outer ribbons 10, 12 also have a predetermined width W1 and the inner ribbons 14, 16 have a predetermined width W2. Helix angles V1, V2 for the outer ribbons 10, 12 and inner ribbons 14, 16, respectively, are thereby defined by:

$$V1 = TAN^{-1}(P1/(\pi D1)), \text{ and}$$

$$V2 = TAN^{-1}(P2/(\pi D2)).$$

The resulting surface areas A1, A2 are therefore defined by:

$$A1 = W1((\pi D1)/COS(V1)), \text{ and}$$

$$A2 = W2((\pi D2)/COS(V2)).$$

For the above equations, the terms W1, W2, P1, P2, D1 and D2 have the same measurement units, such as inch.

The circulating means then has a configuration parameter defined by the ratios of these areas as follows:

$$C = A1/A2.$$

It is to be understood that in the preferred embodiment in which two outer ribbons and two inner ribbons are utilized A1 is the sum of the surface areas of the outer ribbons and A2 is the sum of the surface areas of the inner ribbons. Obviously if the two outer ribbons are identical and correspondingly if the two inner ribbons are identical, the configuration parameter is the same whether the area of one outer ribbon is divided by the area of one inner ribbon or whether both inner and outer ribbons are utilized in the calculation.

Experimentation has determined that the configuration parameter for lithographic printing fluids should be in the range of 0.20 to 0.80. In particular a configurational parameter of 0.67 has been tested and has been found to produce substantially even and constant flow of printing fluid past the surface of the pickup roller. This was done using printing fluid composed of ink having a viscosity in the range of 30–460 Poise and a water content not exceeding 30% of the printing fluid. The rotational speed was in the range of 50–100 RPM and the inner and outer ribbons had the following dimensions:

D1=3.500 in.
D2=2.250 in.
W1=0.1875 in.
W2=0.3750 in.
P1=P2=6.250 in.

Figure 8:
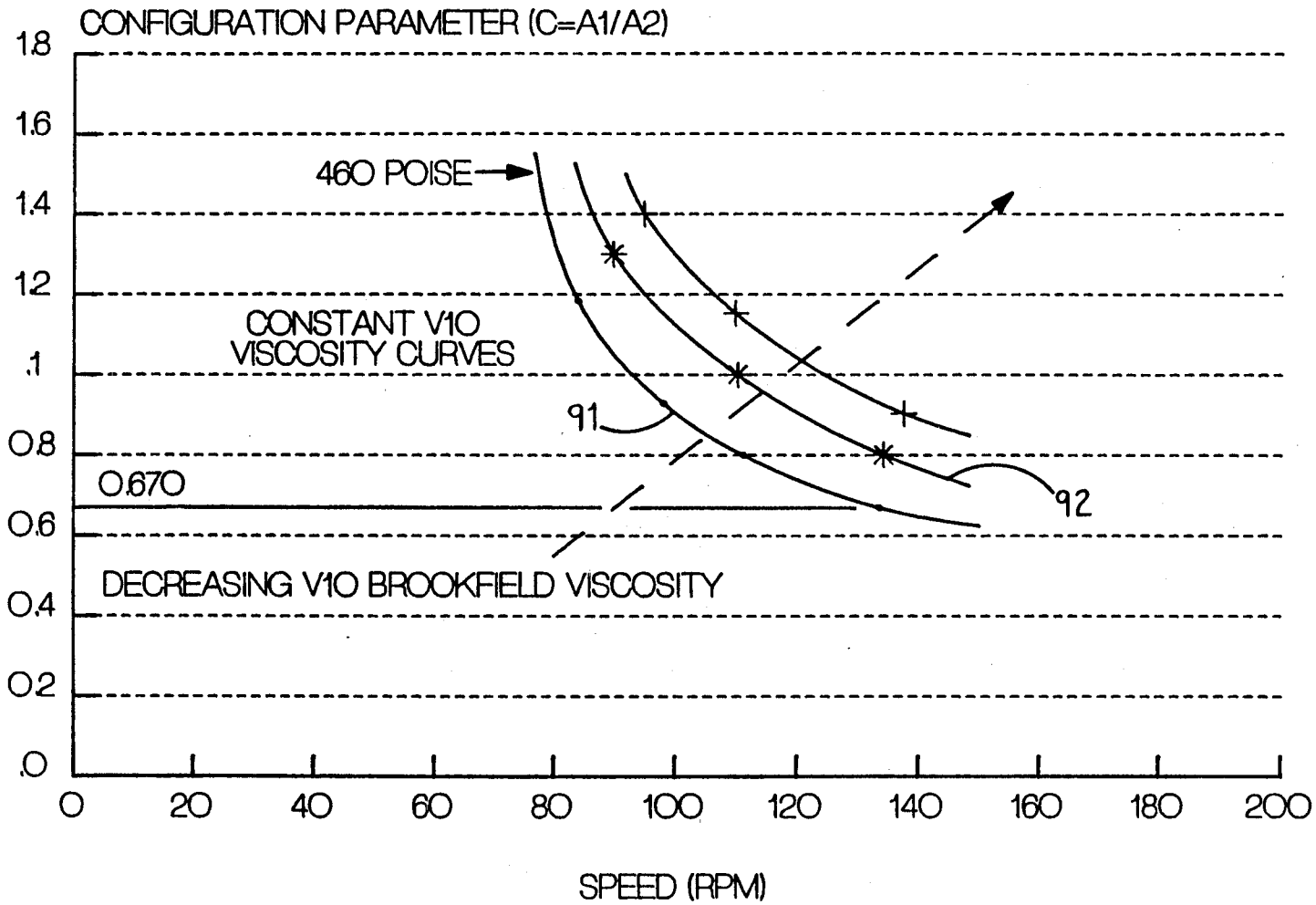
FIG. 8 is a graph depicting the relationship of rotational speed of the printing fluid circulator to different ink viscosities.

The radial clearance of the inner and outer ribbons to the sides of the pan containing the printing fluid circulator was 1.250 in.. The following is an example of the relationship of the speed of rotation of the shaft 18 and therefore of the first and second outer ribbons 10, 12 and the first and second inner ribbons 14, 16 as a function of the type of printing fluid used. As depicted in FIG. 8 the speed of rotation of the shaft 18 is adjusted as a function of the viscosity of the ink for a particular printing fluid circulating means. For example, for a printing fluid circulating means having a configuration parameter of 0.80, a rotational speed of approximately 110 RPM is used for ink having a viscosity as depicted in curve 91. A rotational speed of approximately 130 RPM is used for ink having a viscosity as depicted in curve 92.

It is to be understood that the present invention can also be utilized with a circulating means having only one outer ribbon and one inner ribbon as well as with circulating means having a plurality of outer ribbons and a plurality of inner ribbons. In the preferred embodiment the first and second outer ribbons 10, 12 are attached to the shaft 18 in 180° opposed positions and the first and second inner ribbons 14, 16 are also attached to the shaft 18 in 180° opposed positions.

The first and second outer ribbons 10, 12 have opposite hand helix configurations relative to the helix configurations of the first and second inner ribbons 14, 16. However, the first and second outer ribbons 10, 12 have substantially identical helix configurations, and the first and second inner ribbons 14, 16 also have substantially identical helix configurations.

Figure 4:
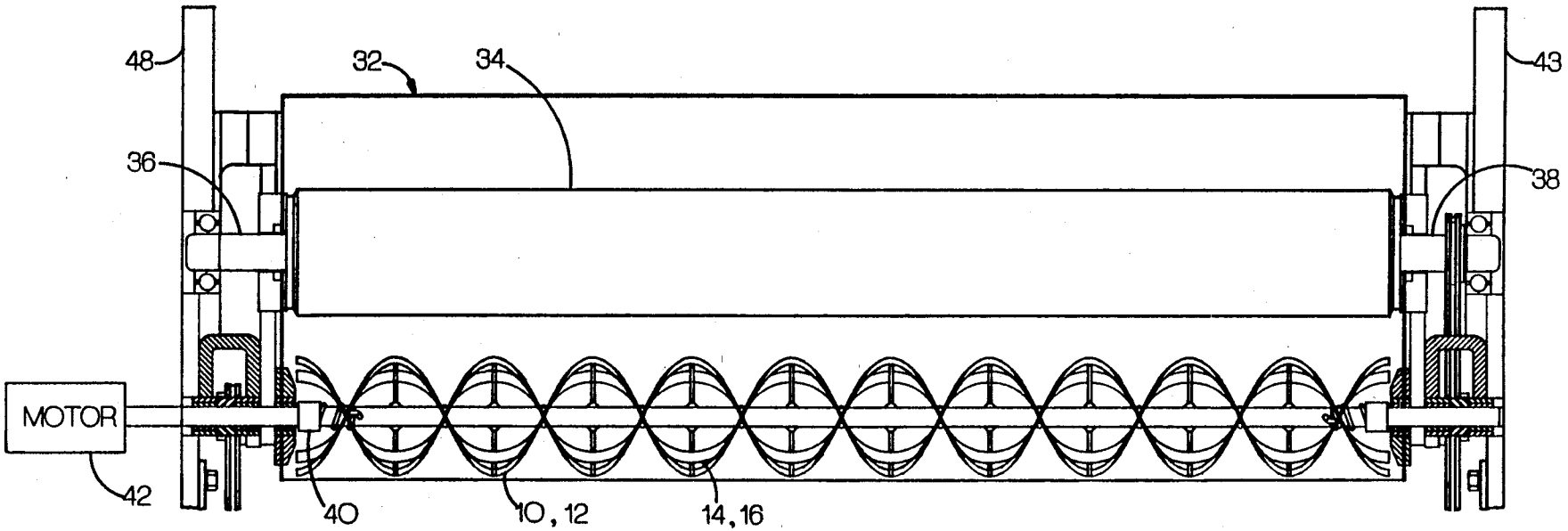
FIG. 4 is a top view of the printing fluid circulating means and of a pickup roller positioned in a pan containing printing fluid.

FIG. 4 is a top view of the circulating means of the present invention mounted in a pan or container means 32. Also mounted in a partially submerged position is a pickup roller 34. Ends 36 and 38 of the pickup roller 34 are mounted in frames 41, 43, respectively, and provide rotation of the pickup roller 34 as is well known in the art. An end 40 of the shaft 18 of the circulating means is connected to a motor 42 for rotation of the shaft 18. Obviously, numerous methods of connecting the shaft 18 to the motor 42 can be utilized. Also it is desirable that the motor 42 provide for varying the speed of rotation of the shaft 18.

Figure 5:
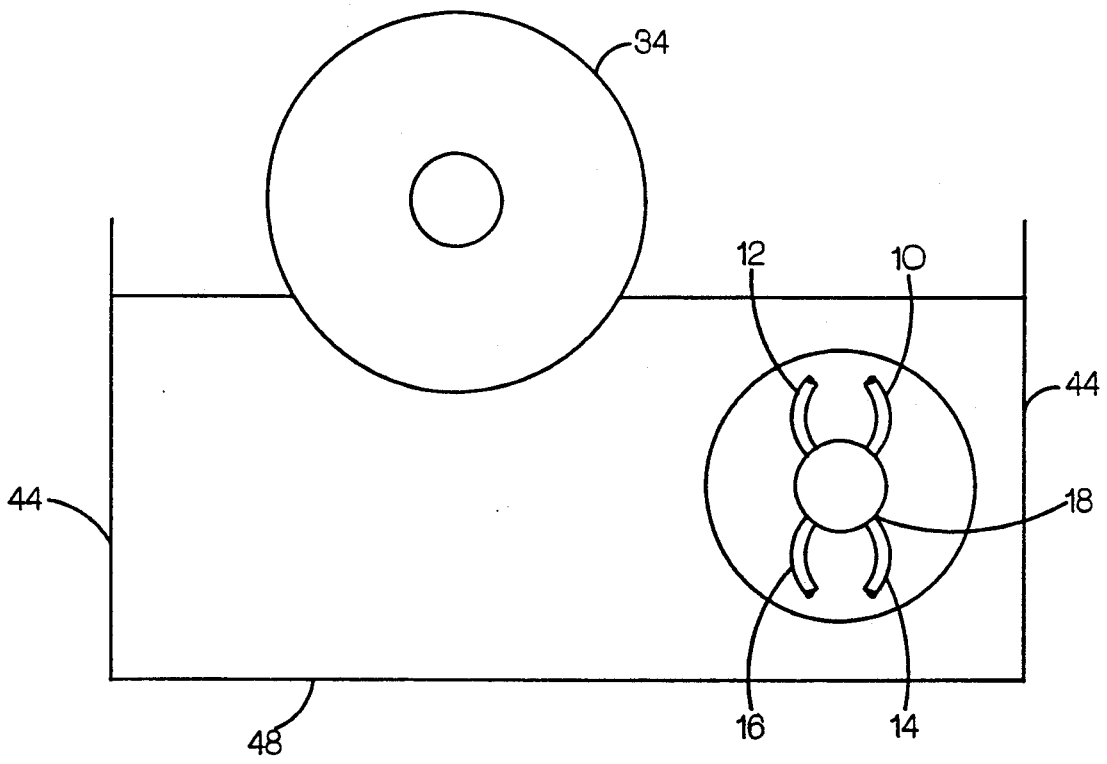
FIG. 5 is a cross-sectional view of the circulating means and pickup roller depicted in FIG. 4.

FIG. 5 is a cross-sectional view of FIG. 4 and shows that the side walls 44, 46 of the container means 32 can be vertical, as opposed to the required sloping pan sides of prior art pans. In the preferred embodiment, it has been found advantageous to position the circulating means approximately 2 to 3 inches away from the pickup roller 34. Due to the novel design of the circulating means, the side wall 44 as well as the bottom 48 of the container means 32 can be as close as ¼ inch to the circulating means. This results in a very compact container means for the printing fluid and as will be explained below results in great space saving in the configuration of the printing press.

Figure 6:
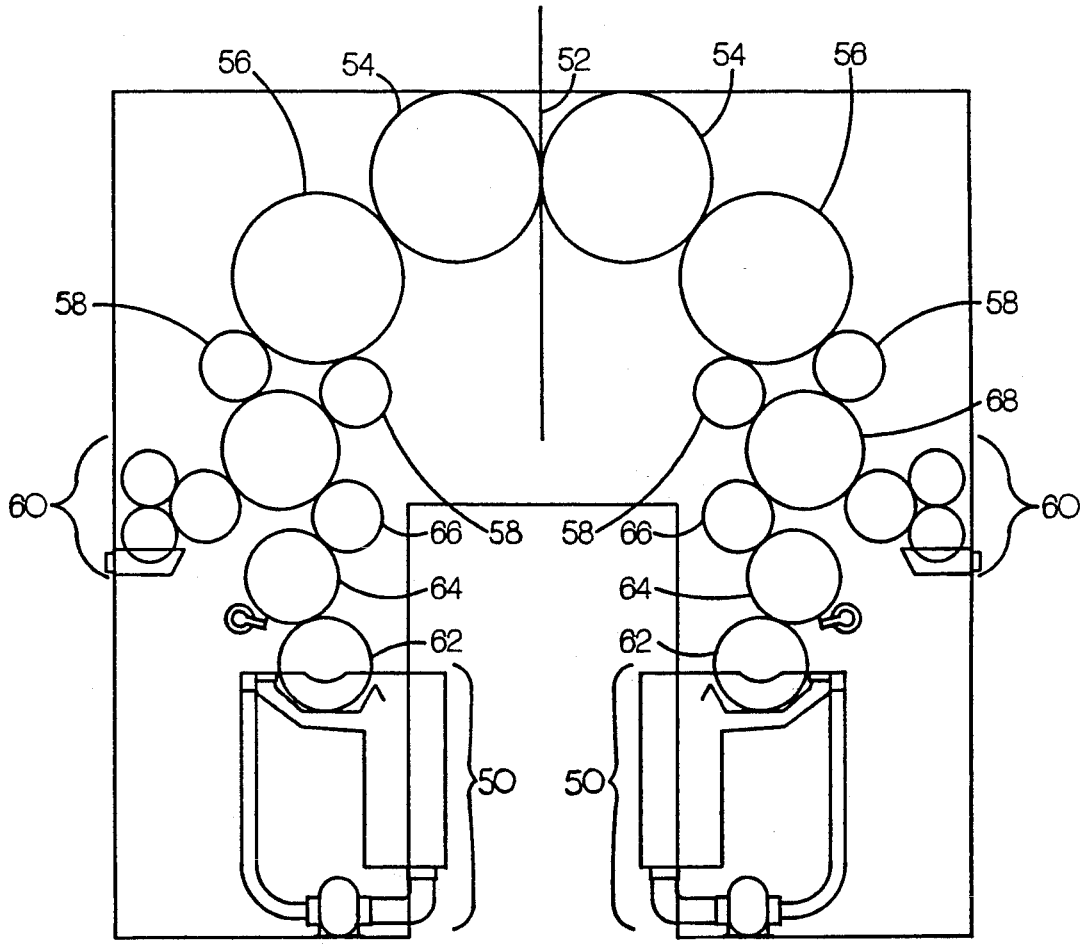
FIG.6 PRIOR ART
FIG. 6 is a schematic diagram of a prior art keyless offset printing press.

FIG. 6 depicts a prior art printing press configuration in schematic form. In particular, a keyless offset printing press is depicted and as can be seen the recirculating system 50 requires significant space.

As depicted in FIG. 6, a paper web 52 is printed by means of ink transfer from a conventional rubber blanket printing cylinder 54, which receives ink from a conventional planographic printing plate mounted on a plate cylinder 56. The lithographic printing plate mounted on cylinder 56 in turn receives the ink and the dampening water necessary to accomplish image differentiation at the plate surface from a printing fluid carried by rotationally cooperating form rollers 58. The printing fluid consists of a mixture of dampening water from dampener system 60 and oil-based lithographic ink from recirculating system 50 and is formulated so that the oily ink portion forms a substantially continuous medium with water admixed or dispersed therein. The printing fluid is controllably metered to the form rollers 58.

Figure 7:
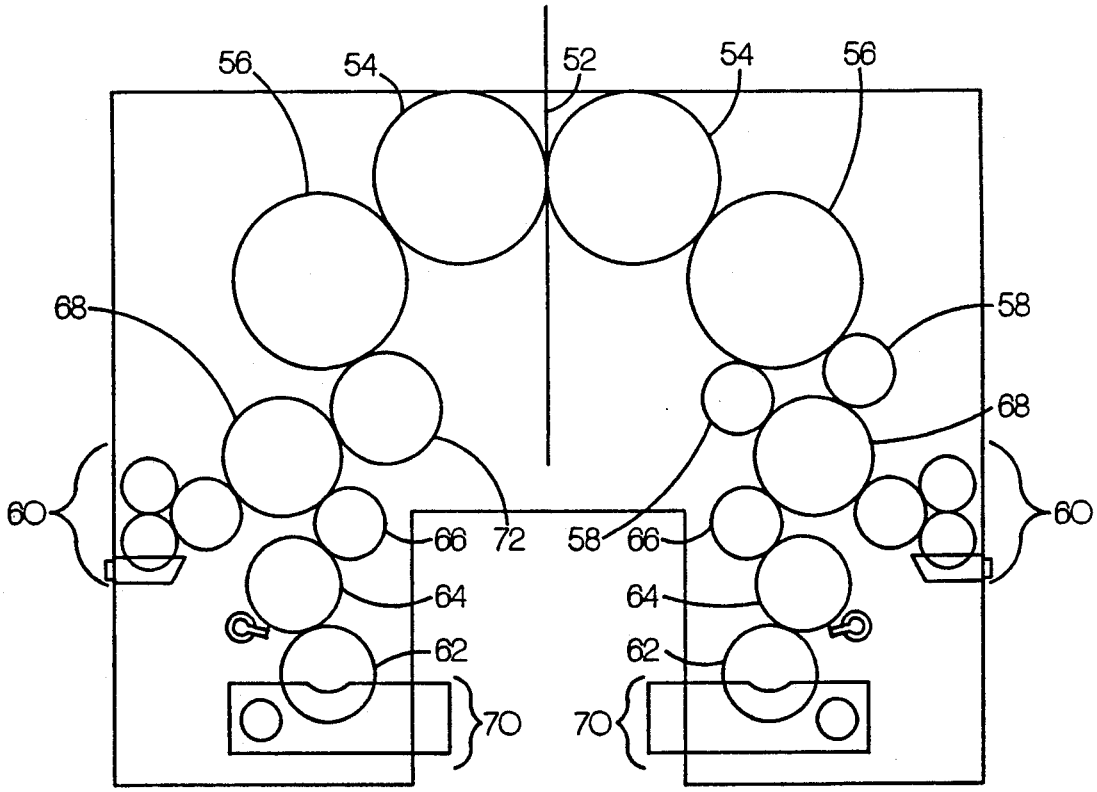
FIG. 7 is a schematic diagram of a printing pres utilizing the present invention, and in particular, depicting a keyless offset printing press having two form rollers and a keyless offset printing press having a single large form roller. (The present invention can also be utilized with printing presses having more than two form rollers)

The recirculating system 50 provides ink to pickup roller 62. The ink is then transferred by rollers 64, 66 and 68 to the form rollers 58. FIG. 7, clearly shows the space saving advantage of using the circulating means 70 of the present invention.

In the FIG. 7, roller 68 conveys printing fluid to one form roller 72 (left hand side of FIG. 7) or to a pair of form rollers 58 (right hand side of FIG. 7), thence to plate cylinder 56, to blanket printing cylinder 54 and to paper 52 as previously described.

The press configuration having at least a pair of form rollers 58 (right hand side of FIG. 7) is used for printing, for example, two different pages for one revolution of the plate cylinder 56 as is well known, for example, in the United States. The press configuration having only one form roller 72 (left hand side of FIG. 7) is used for printing, for example, two identical pages for one revolution of the plate cylinder 56 as is well known, for example, in Japan. In order to provide true rolling of the soft surface form roller with the hard surface plate cylinder, the circumference of the soft surface form roller is related to the circumference of the hard surface plate cylinder according to the teachings of U.S. Pat. No. 2,036,835 (hereby incorporated by reference).

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A printing fluid circulating means for use in a printing press having a container means for containing printing fluid and having a rotatable pickup roller partially submerged in the printing fluid in the container means and having a surface for picking up the printing fluid, comprising:

at least one outer ribbon having a predetermined diameter and a predetermined surface area;

at least one inner ribbon having a predetermined diameter and a predetermined surface area, said diameter of said at least one inner ribbon being less than said diameter of said at least one outer ribbon and said predetermined surface area of said at least one outer ribbon being a function of said predetermined surface area of said at least one inner ribbon;

each of said at least one outer ribbon and said at least one inner ribbon having a substantially helix configuration, said helix configuration of said inner ribbon being opposite relative to said helix configuration of said outer ribbon; and rotatable means for supporting said at least one outer ribbon and said at least one inner ribbon about a common axis;

said circulating means being submerged in the printing fluid in said container means in spaced relation to said pickup roller such that rotation of said circulating means causes the printing fluid to flow substantially evenly and substantially continuously past the surface of the pickup roller;

said at least one outer ribbon and said at least one inner ribbon having predetermined pitches P1, P2, respectively, predetermined widths W1, W2, respectively and predetermined diameter D1, D2, respectively; said at least one outer ribbon and said at least one inner ribbon having predetermined helix angles V1, V2, respectively, defined by:

$$V1 = TAN^{-1}(P1/(\pi D1)), \text{ and}$$

$$V2 = TAN^{-1}(P2/(\pi D2)).$$

2. The printing fluid circulating means according to claim 1, wherein said predetermined surface ares are defined by :

$$A1 = W1((\pi D1)/COS(V1)), \text{ and}$$

$$A2 = W2((\pi D2)/COS(V2));$$

A1 being said predetermined surface area of said at least one outer ribbon and A2 being said predetermined surface area of said at least one ribbon.

3. The printing fluid circulating means according to claim 2, wherein said circulating means has a configuration parameter defined by:

said configuration parameter being a ratio of the predetermined surface area of said at least one outer ribbon to the predetermined surface area of said at least one inner ribbon.

4. The printing fluid circulating means according to claim 3, wherein said configuration parameter is in the range of 0.20 to 0.80.

5. The printing fluid circulating means according to claim 3, wherein said constant is approximately 0.67.

6. The printing fluid circulating means according to claim 1, wherein said predetermined pitch of said at least one outer ribbon is equal to said predetermined pitch of said at least one inner ribbon.

7. The printing fluid circulating means according to claim 1, wherein said circulating means further comprises means for rotating in only one direction said rotatable means.

8. A printing fluid circulating means for use in a printing press having a container means for containing printing fluid and having a rotatable pickup roller partially submerged in the printing fluid in the container means and having a surface for picking up the printing fluid, comprising:

at least one outer ribbon having a predetermined diameter D1 and a predetermined surface area A1;

at least one inner ribbon having a predetermined diameter D2 and a predetermined surface area A2, said diameter D2 of said at least one inner ribbon being less than said diameter D1 of said at least one outer ribbon and said predetermined surface area A1 of said at least one outer ribbon being less than said predetermined surface area A2 of said at least one inner ribbon;

each of said at least one outer ribbon and said at least one inner ribbon having a helix configuration, said helix configuration of said inner ribbon being opposite relative to said helix configuration of said outer ribbon;

said at least one outer ribbon and said at least one inner ribbon having predetermined pitches P1, P2, respectively, predetermined widths W1, W2, respectively, and said at least one outer ribbon and said at least one inner ribbon having helix angles V1, V2, respectively, defined by $$V1 = TAN^{-1}(P1/(\pi D1)), \text{ and}$$

$$V2 = TAN^{-1}(P2/(\pi D2)),$$

said predetermined surface areas A1, A2, respectively, defined by $$A1 = W1((\pi D1)/COS(V1)), \text{ and}$$

$$A2 = W2((\pi D2)/COS(V2)),$$

and said circulating means having a configuration parameter defined by ti $C = A1/A2$;

said configuration parameter being a ratio of the predetermined surface area A1 of said at least one outer ribbon to the predetermined surface area A2 of said at least one inner ribbon, and said configuration parameter being in the range of 0.20 to 0.80;

rotatable means for supporting said at least one outer ribbon and said at least one inner ribbon about a common axis;

said circulating means being submerged in the printing fluid in said container means in spaced relation to said pickup roller such that rotation of said circulating means causes the printing fluid to flow substantially evenly and substantially continuously past the surface of the pickup roller.

9. The printing fluid circulating means according to claim 8, wherein said circulating means has a plurality of outer ribbons and a plurality of inner ribbons.

10. The printing fluid circulating means according to claim 8, wherein said circulating means has first and second outer ribbons and has first and second inner ribbons, said first and second outer ribbons positioned opposite one another on said rotatable means for supporting and said first and second inner ribbons positioned opposite one another on said rotatable means for supporting.

11. The printing fluid circulating means according to claim 8, wherein said predetermined pitch P1 of said at least one outer ribbon is equal to said predetermined pitch P2 of said at least one inner ribbon.

12. The printing fluid circulating means according to claim 8, wherein said circulating means further comprises means for rotating in only one direction said rotatable means.

13. The printing fluid circulating means according to claim 8, wherein said constant is approximately 0.67.

14. A printing fluid circulating means for use in a printing press having a container means for containing printing fluid and having a rotatable pickup roller partially submerged in the printing fluid in the container means and having a surface for picking up the printing fluid, comprising:

at least first and second outer ribbons each having a predetermined diameter and each having a predetermined surface area;

at least first and second inner ribbons each having a predetermined diameter and each having a predetermined surface area, said predetermined diameters, of said inner ribbons being substantially equal to one another, said predetermined diameters of said inner ribbons, being less than said predetermined diameters of said outer ribbons and said surface areas of said outer ribbons being less than said surface areas of said inner ribbons;

each of said outer ribbons and each of said inner ribbons having a helix configuration, said helix configuration of said inner ribbons being opposite relative to said helix configuration of said outer ribbons;

rotatable means for supporting said outer ribbons and said inner ribbons about a common axis;

said circulating means being submerged in the printing fluid in said container means in spaced relation to said pickup roller such that rotation of said circulating means causes the printing fluid to flow substantially evenly and substantially continuously past the surface of the pickup roller;

each of said outer ribbons and said inner ribbons having a predetermined pitch P, a predetermined width W, a predetermined diameter D, and a helix angle V, defined by:

$$V = TAN^{-1}(P/(\pi D)), \text{ and}$$

wherein each of said outer ribbons and said inner ribbons has an area A, defined by:

$$A = W((\pi D)/COS(V)).$$

15. The printing fluid circulating means according to claim 14, wherein the circulating means has an outer helix area equal to the sum AO of the areas of said outer ribbons and has an inner helix area equal to the sum AI of the areas of said inner ribbons, and wherein said circulating means has a configuration parameter defined by:

$$C = AO/AI;$$

said configuration parameter being a ratio of said outer helix area to said inner helix area.

16. The printing fluid circulating means according to claim 15, wherein said configuration parameter is in the range of 0.20 to 0.80.

17. The printing fluid circulating means according to claim 14, wherein said configuration parameter is approximately 0.67.

18. The printing fluid circulating means according to claim 14, wherein said circulating means further comprises means for rotating in only one direction said rotatable means.

* * * * *